US006226948B1

(12) United States Patent
Trout

(10) Patent No.: US 6,226,948 B1
(45) Date of Patent: May 8, 2001

(54) METHOD AND APPARATUS FOR WATERPROOFING CONCRETE

(76) Inventor: John F. Trout, 1556 Kirkwood, Geneva, IL (US) 60134

( * ) Notice: Subject to any disclaimer, the term of this patent is extended or adjusted under 35 U.S.C. 154(b) by 0 days.

(21) Appl. No.: 09/320,397

(22) Filed: May 26, 1999

(51) Int. Cl.[7] ..... E02D 37/00

(52) U.S. Cl. ..... 52/514.5; 52/741.41; 52/742.13; 52/749.1; 52/749.13; 81/27; 173/90; 405/269

(58) Field of Search ..... 52/514.5, 742.13, 52/741.41, 749.1, 749.13; 81/27; 173/90, 132; 405/269

(56) References Cited

U.S. PATENT DOCUMENTS

| | | | | |
|---|---|---|---|---|
| 4,382,720 | * | 5/1983 | Vonach | 405/269 |
| 5,079,881 | * | 1/1992 | Haage et al. | 52/514.5 |
| 5,257,486 | * | 11/1993 | Holmwall | 52/514.5 |
| 5,881,523 | * | 3/1999 | Quantrochi, Jr. | 52/514.5 |

* cited by examiner

*Primary Examiner*—Christopher T. Kent

(74) *Attorney, Agent, or Firm*—Taylor & Aust, P.C.

(57) ABSTRACT

An injection packer, injection packer installation/removal tool, and method of use thereof are especially suited for use in the repair of concrete structures and the like. The injection packer includes a body that is removable from a nonmetallic expansion member that may remain within a repair bore after the injection material is injected into the repair bore. The packer body includes a shank, nozzle, and keyed head with an injection bore therethrough. The nozzle is threaded to engage a nonmetallic nut attached to the expansion member. In use, as the packer body is rotated in a first direction the expansion member is compressed between the nut and the packer body shank, thereby radially bulging the expansion member. At this point fluid may be injected through the injection packer and into the bore and crack(s). As the packer body is rotated in a second direction the expansion member is uncompressed. The packer body is easily detachable from the expansion member. However, the expansion member may be removed completely from the bore. Ribs or ears on the expansion member assist in preventing rotation of the injection packer during compression. The tool includes a driver member slidably coupled to a socket keyed to receive the keyed head and adapted to rotate the injection packer in the correct direction for insertion and removal thereof.

30 Claims, 4 Drawing Sheets

METHOD AND APPARATUS FOR WATERPROOFING CONCRETE

BACKGROUND OF THE INVENTION

1. Field of the Invention.

The present invention relates to methods for waterproofing concrete and concrete-like structures and, more particularly, to an injection packer and apparatus for waterproofing concrete and concrete-like structures.

2. Description of the Related Art.

Concrete and other similar substances have been known and used for many years. However, no matter how much care is taken in the preparation or placement of concrete and concrete-like structures cracks, voids, and fissures can develop causing various problems. The problem of cracking or of defective joints in concrete structures is a source of concern. One type of problem associated with cracks, voids, fissures, and/or defective joints is water leakage. Water leakage into basements, tunnels, pits, and other concrete structures as a result of cracks and/or other defects in the concrete is of great concern and as old a problem as concrete itself. Cracks can be categorized into 1) intermittent leaking; and 2) constant or continuous leaking. Intermediate or "non-active" leaking includes leaking only when the water table reaches a particular level, such as will occur immediately after a rain. Constant leaking or "active leaking" as it is known in the industry, is water that is constantly running through the concrete structure via a crack, defect, or the like.

Various remedies have been devised in an attempt to remedy or stop intermittent leaking including the use of mortars and epoxies as sealing and/or patching agents since such materials may be used during the dry spells. Both mortars and epoxies are relatively effective when leaking is not present in that they bond quickly and provide a rigid repair. However, over time such repairs can also crack.

Active leaks are much more difficult to contain. Mortars, epoxies and similar materials are not practical in active leak repair since they cannot "set up" or cure to hardness in the presence of running water. Therefore, such methods as gutters, trenches, and other water diversion methods are used to alleviate active leaking. In contrast, a non-diversion method for stopping water that enjoyed success upon introduction was the use of polyurethane resins. When polyurethane resins are injected under pressure into the concrete, the polyurethane resins expand upon contact with the moisture. Polyurethanes can be divided into two major categories characterized by their reaction to water, hydrophobic and hydrophilic. Hydrophobic polyurethanes use water as a reacting agent only, thus absorbing very little water. The cured material is relatively free of water making it very resistant to post-cured shrinkage. Hydrophilic polyurethanes can incorporate large quantities of water thereby creating shrinkage within the cured material as the incorporated water evaporates. Hydrophobic polyurethanes are generally more versatile and are suited for concrete crack injection. Since the introduction of polyurethanes, various polyurethane formulations have been devised.

Polyurethane formulations are today injected directly into the water flow where they react with the water. The reaction causes the polyurethane formulation to expand into a strong, sticky foam to obstruct continued flow. Reaction times vary with respect to the particular polyurethane formulation used. Use of an accelerator added to the polyurethane can speed up reaction or gel time depending on the rate of water flow. If the water is flowing quickly, a rapid "gel" accelerator is added to the polyurethane resin formulation. This causes the polyurethane resin formulation to react before the resin is flushed from the crack. If the water flow is low, a small amount or accelerant may be used, if any at all. Of course, the less accelerant used the slower the reaction or cure time of the resin. Another consideration is that less accelerant allows a greater amount of resin to be injected into the crack and time to work with it as well.

Once the resin is introduced into the water stream, it must have time to react before it is flushed from the void by the moving water. One technique that allows the polyurethane to gel, is to drill injection holes diagonally to intersect the structural crack or void some distance from the structure surface. Generally, a ⅝" bore size is used for the hole. Smaller drill bits for smaller bore sizes may be too fragile to drill the deep holes usually required.

In utilizing the boring technique, the porting connection at the hole presents a challenging problem. The porting connection must be made against a flowing stream of water (active flow) without leaking. Further, the porting connection must withstand resin injection pressures of over 3,000 psi (pounds per square inch). Devices for the porting connection are referred to as "packers."

There are in general two types of packers: 1)expanding, and 2) non-expanding. The non-expanding are tapered plugs with a hole through their length, and a grease, or other type of fluid coupler, fixed at the external (fat) end of the plug. The non-expanding plugs are driven into the holes until they are stuck fast. The resin connection is made at the external fitting. The non-expanding plug types work fairly well in smaller holes, but are seldom used in ⅝" diameter holes where the pressure against them is greater due to the larger diameter of the hole.

There are two types of expanding packers. One type is similar to the non-expanding plug described above, except that the tapered plug is threaded externally and screwed into a plastic sleeve that is forcibly expanded as the plug advances within it. The sleeve expands until it and the plug are bound within the hole. The resin is then injected through the zerk type grease fitting thereon. A problem with both types of plugs described above is that such plugs are tapered, and as a result, the expansive force is focused on a relatively narrow ring. This allows less surface contact to provide the friction to resist the fluid pressure.

The second type of expandable plug is the most widely used. It consists of a metal tube with an exterior straight thread running its entire length and an interior pipe thread at one end. The interior thread accepts a zerk type grease fitting or the like for the resin hose connection. The exterior thread supports two nuts and their washers, one at each extremity of a rubber tube segment. As the nut at the front of the packer is rotated, the nut advances on the stem to compress the rubber tube segment disposed between the two washers, thereby expanding the rubber segment and binding the packer against the wall of the hole. The resin is then injected through the zerk type fitting.

However, such packers as described above present several problems. First, such packers are costly. Second, such packers are extremely difficult to remove from the injection hole. The projecting segment of such packers may be broken off, leaving a portion of the packer within the hole. However, leaving a portion of the packer within the hole creates a problem if the hole is to be patched. Removal of the packer may require chipping, prying, and sometimes drilling. In some applications, metal packers having ferrous components must be completely removed in order to prevent corrosion within the wall. Expansive forces exerted by corrosion may cause the concrete to spall or leach objectionable stains.

Full extraction of metal packers is extremely difficult. Initially, the stem or nut must be rotated counter-clockwise to relax the rubber segment. If the stem rotates, the nut and its washer may become disengaged and left within the hole where they are then almost impossible to extract. If the forward nut is loosened and the rubber segment is relaxed, the stem can be gripped and pulled from the hole. If the polyurethane material has even partially set or cured, removal becomes even more difficult. A vise grip type tool is usually used in such attempts as the device has no feature which lends itself to gripping for removal.

Also, holes drilled at an angle into concrete are sometimes oversize and eccentric for a depth of approximately an inch as the drill bit defines its drilling direction. This especially holds true when dealing with poor concrete. In such cases, the hole or bore diameter only becomes true and consistent after the drill bit becomes more confined within its own bore. When a hole is oversize and eccentric at the beginning, expanding rubber packers are difficult to set because they are too short to reach the concentric diameter of the bore needed to grasp the rubber hose segment. If the rubber hose segment of the packer is not grasped by the hole by contact with the walls of the hole, the entire packer assembly will spin as the nut thereof beneath the zerk is rotated. This difficulty is usually overcome by removing the packer and advancing one of the nuts to compress, and thereby expand, the rubber hose segment sufficiently to gain friction against the walls of the hole when the packer is re-inserted.

Worn bits can also be a source of eccentric and undersized holes. When holes are undersized as a result of worn bits, it is difficult to insert expanding rubber type packers. Such packers cannot be driven into the hole without danger of damaging the zerk fitting.

Yet another problem with such packers is that, due to the above problems, they seldom withstand the injection pressures sought by most contractors.

What is thus needed in the industry is a cost effective packer.

What is further needed in the industry is a packer that can be easily and fully removed.

What is still further needed in the industry is a packer that can withstand injection pressures of 4,000 psi in a ⅝" diameter hole, yet offer easy and full removal.

What is still further needed in the industry is a packer that can place its expansive, or compressible, sealing component beyond the proximate, and usually eccentric, hole segment.

What is yet further needed in the industry is a packer that can be easily inserted into a slightly undersized hole without damage to the packer.

SUMMARY OF THE INVENTION

The present invention is directed to an injection packer, an injection packer tool, and a method of use thereof for the injection of substances into a structure. Such has use in the waterproofing of concrete and other structures having similar compositions.

In one form, the present invention is an injection packer. The injection packer includes a body adapted to set, expand, contract, and remove if necessary, an expansion member with the aid of a compression member. The expansion member radially bulges upon compression between the body and the compression member.

In one embodiment, the body has a shank, a nozzle on one end of the shank, a keyed flange on another end of the shank, and a bore extending therethrough. An elastomeric expansion member has a bore configured to receive the nozzle. A compression member is preferably rotationally fixed to the expansion member so that as the body rotates in a given direction, the compression member compresses the expansion member between itself and the shank. The compression member is molded and/or chemically bonded to the expansion member.

Rotation in the opposite direction uncompresses the expansion member and can lead to total removal of the body from the expansion member and compression member. Radially outwardly extending tapered ribs or cleats are disposed on the surface of the expansion member for preventing rotation of the expansion member, preferably on the aft surface thereof. If the hole is not oversized, the aft location and tapered configuration allows the cleats to be shredded from the elastomeric member, rather than being imbedded into, and thereby distorting, the elastomeric member.

In another form, the present invention is a setting/removal tool for the present injection packer. A reciprocating driver assembly is attached to a rotatable socket that is keyed to accept the present injection packer. The socket is configured to allow axial pulling and pushing of the injection packer and allow rotation of the packer body in the appropriate directions for setting and removal.

When the present tool is used to drive the injection packer into the bore the thrust is taken at the compression member so that the elastomeric member, due to the bond between it and the compression member, is towed, rather than pushed into the hole. If the elastomeric member were pushed, it would bulge and otherwise distort, thus increasing the resistance to entry. The tool is also used to rotate the injection packer both in the setting and removal directions while still positively engaging the injection packer body, and removing any and all portions of the injection packer.

In a further form, the present invention is a method of injecting a substance into a structure utilizing an injection packer in accordance with the present principles and an injection packer setting/removal tool in accordance with the present principles.

BRIEF DESCRIPTION OF THE DRAWINGS

The above-mentioned and other features and advantages of this invention, and the manner of attaining them, will become more apparent and the invention will be better understood by reference to the following description of embodiments of the invention taken in conjunction with the accompanying drawings, wherein.

Corresponding reference characters indicate corresponding parts throughout the several views. The exemplifications set out herein illustrate preferred embodiments of the invention, and such exemplifications are not to be construed as limiting the scope of the invention in any manner.

DETAILED DESCRIPTION OF THE INVENTION

Figure 1:
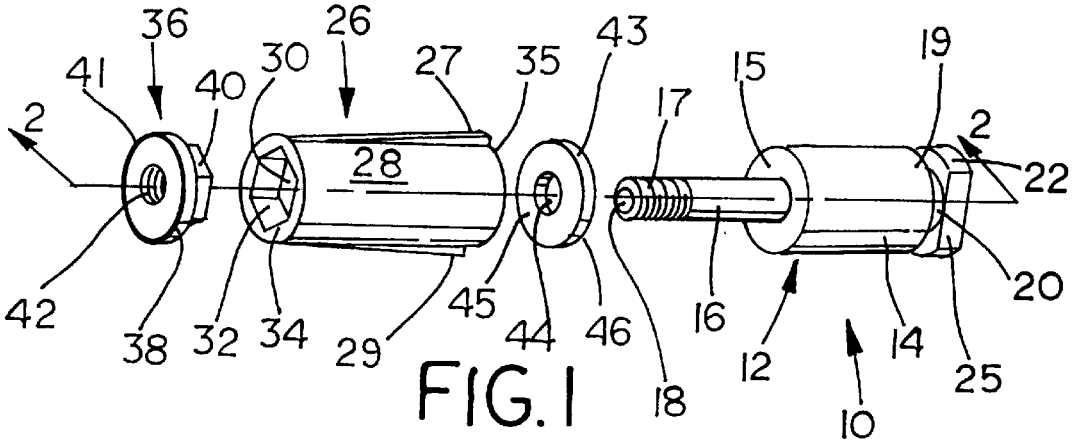
FIG. 1 is an exploded perspective view of the present injection packer.

Referring now to the drawings and more particularly to FIG. 1, there is shown an embodiment of an injection packer 10. Injection packer 10 may be used for polyurethane injection, cement grouts, and/or epoxies. Injection packer 10 includes packer body 12, expansion member or plug 26, and compression washer/nut 36. Packer body 12 includes cylindrical shank 14 having a diameter corresponding to the desired bore size. For example, a ⅜" bore will accept an injection packer having a cylindrical shank having a diameter of ⅜". In this regard, packer bodies having shanks of different diameters may be produced to accommodate the bore size. However, for injection of polyurethane, a bore size of ⅝" is generally used and thus the packer body would have a shank diameter of ⅝". Axially extending from end 15 of shank 14 is nozzle or stem 16 having external threads 17 on an end of nozzle 16 distal end 15 of shank 14. Axially extending from end 19 of shank 14 is neck 20 terminating in keyed flange nut or head 22. Keyed flange nut 22 is characterized by two flats 23 and 25 on opposite sides thereof defining an oval shape. Bore 18 axially extends through nozzle 16, shank 14, neck 20 and keyed flange nut 22. Internal threads 24 are disposed at keyed flange nut 22 and are sized to receive an injection nipple (not shown) or zerk fitting (not shown) as is known in the art.

Packer body 12 is preferably made of metal such as stainless steel and, more particularly, 303S stainless. Also, it is preferable that packer body 12 is formed as one piece. As indicated above, shank 14 can have various dimensions including various diameters. As well, shank 14 of packer body 12 may have different lengths. Injection packer 10 further includes an elastomeric, rubber, deformable plastic or the like expansion member, stopper, or plug 26. Expansion member 26 is defined by cylindrical body 28 made from an elastomeric, rubber, plastic, or any deformable type material, such as Santoprene, that will radially expand when axially compressed, and that will contract when compression is relieved. A rib, cleat or the like 27 and preferably at least another rib 29 are disposed on the outside surface of cylindrical body 28. In one form, three such ribs are disposed on the outside surface of cylindrical body 28 and equidistantly placed. While ribs 27 and 29 are shown extending the full axial length of cylindrical body 28 it should be understood that ribs 27 and 29 may take many forms, shapes and be in any number. As an example, each rib may extend only a short distance from end 35. Preferably, ribs 27 and 29, and all such ribs of any number and shape, are disposed on cylindrical body 28 equidistant from each other. The ribs provide rotational stability (restrict rotation) during insertion and compression/expansion. The ribs further get stripped off in a tight bore, while the ribs grasp the walls of the bore during expansion to help prevent rotation of cylindrical body 28 and binds the injection packer in the bore. Preferably, ribs 27 and 29 tapered at the front end (end 34 of cylindrical body 28) for easy insertion into a bore and from the base thereof to its apex. In another form, rather than ribs, the outer diameter of cylindrical body 28 may have an enlarged annular end at end 35 or be tapered to prevent rotation. Packer 10 further includes washer 43 having bore 44 therein for receipt over nozzle 16. Washer 43 defines front surface 45 that is adapted to abut end 35 of cylindrical body 28 and rear surface 46 adapted to abut surface 15 of packer body 14. Washer 43 aids in preventing tearing of cylindrical body (expander) 28 upon relative rotation during use. Preferably, washer 43 is made of a low friction material such as HDPE, graphite, or the like.

Expansion member body 28 includes internal bore 30 of a diameter sized to receive and allow nozzle 16 to extend therethrough and defines end 34 and end 35. Disposed at end 34 and coaxial with bore 30 is recess 32. Recess 32 is hexagonally shaped to accommodate hexagonal nut portion 40 of compression washer/nut 36.

Figure 10:
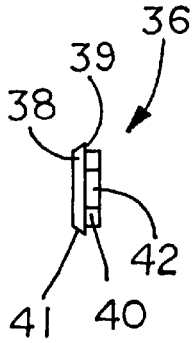
FIG. 10 is an enlarged side view of the present compression washer/nut member.

With additional reference now to FIG. 10, compression washer/nut 36 is shown. Compression washer/nut 36 is characterized by annular washer portion 38 at one end of hexagonal nut portion 40 providing a compression surface that abuts end 34 of expansion member 26. Annular washer portion 38 includes annular taper 41 on a front portion of washer portion 38 that aids in the insertion of the injection packer into the bored hole. Compression washer/nut 36 may be made of a suitable plastic such as nylon or the like. This provides the lubricity to allow the injection packer to rotate without binding the plug. In another form, washer/nut 36 may be brass and washer portion 38 may be sufficiently thin such that it can deflect or bend slightly to accommodate a slightly undersized hole.

Additionally, compression washer/nut 36 has central bore 42 that is threaded complementary to threads 17 of nozzle 16. Nut portion 40 is configured to be received in and cooperate with recess 32 such that rotation of compression washer/nut 36 is prevented while within recess 32. A complementary hexagonal shape between recess 32 and nut portion 40 provides this feature. It should be understood that any complementary configuration of recess 32 and or nut portion 40 that aids in preventing rotation of compression member 36 relative to expansion member 26 may be used. As an example, rather than a hexagonal nut portion and recess, nut portion 40 may be knurled and recess 32 may be complementary thereto or generally rounded and undersized to make an interference fit therebetween. In this latter case, nut/washer 36 may be bonded chemically or otherwise to cylindrical body 28. Further, when using bonding, washer/nut 36 may be used in an inverted manner, wherein washer portion 38 is bonded to end 34 and nut portion 40 is axially outside of cylindrical body 28. Preferably, compression member 36 is bonded in any suitable manner to body 28 to avoid spinning when tightening or loosening the injection packer. In one form, compression washer/nut 36 is vulcanized into or onto expansion member 26. Of course, other forms of bonding, such as adhesives and the like may also be used to secure the compression member into or onto the expansion member. If the washer/nut threads are strong enough and the washer/nut is bonded to cylindrical body 28, then cylindrical body 28 is pulled rather than pushed. Pushing causes cylindrical body 28 to ball up. Washer/nut 36 is preferably insert molded along with cylindrical body 28.

Figure 2:
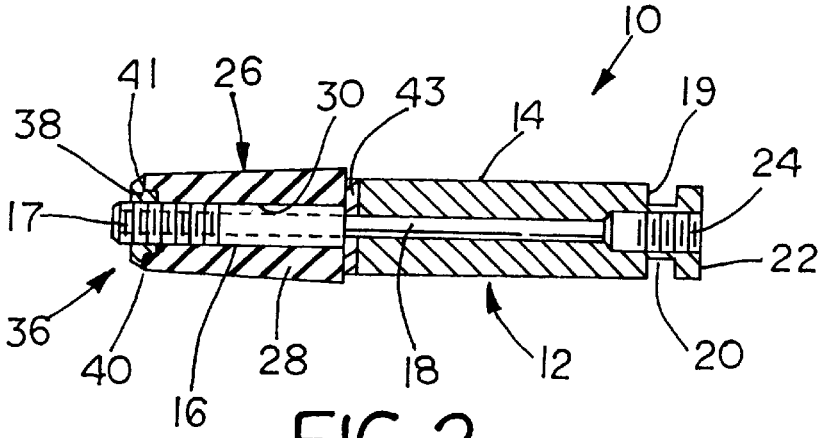
FIG. 2 is a side sectional view of an exemplary assembled injection packer having an elongated shank.
Figure 3:
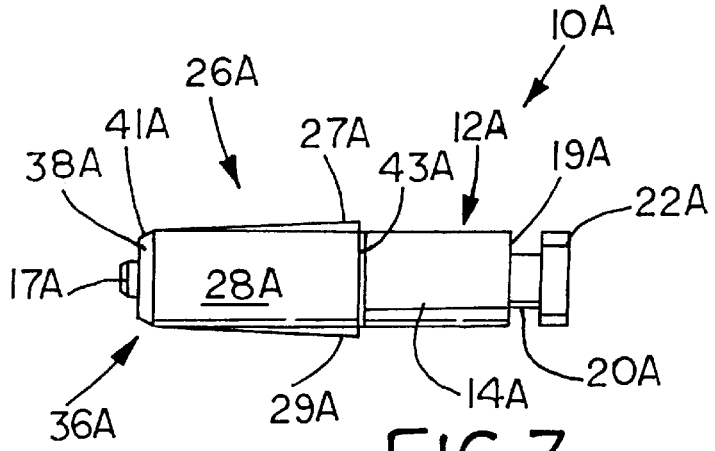
FIG. 3 is a side view of an alternative exemplary assembled injection packer having a shank shorter than the shank of FIG. 2.

With additional reference to FIGS. 2 and 3, two injection packers 10*a* and 10*b* respectively are shown in an assembled state. In FIGS. 2 and 3 like reference numbers to like features in FIG. 1 are designated by an "a" and "b" suffix respectively. Packer body 12*a* of injection packer 10*a* has elongated shank 14*a* between nozzle 16*a* and neck 20*a*. An axially longer shank allows setting of the packer in what would be the remote concentric segment of irregular holes. In contrast to shank 14*a* of injection packer 10*a* of FIG. 2, shank 14*b* of injection packer 10*b* of FIG. 3 is axially shorter. It should thus be evident from the above that the shank portion of the packer body can be any length and diameter within practical limits, and achieve the present results. While the shanks of the injection packers 12*a* and 12*b* of FIGS. 2 and 3 respectively have different axial lengths, their respective nozzles 16*a* and 16*b* are preferably the same axial length. This is to accommodate the use of the same size expansion member 26. Of course, if different size expansion members were used the length of the nozzle would be adjusted accordingly. Various permutations of shank and nozzle dimensions are possible within the principles of the present invention.

In the assembled state of the present injection packer as depicted in FIGS. 2 and 3, expansion member body 28 is slidably disposed over nozzle 18 via expansion member bore 30 such that end 35 of expansion body 28 abuts end 15 of injection packer body 12. Compression washer/nut 36 is fixedly disposed in recess 32 of plug body 28 while threaded end 17 of nozzle is threadedly received in bore 42 of compression washer/nut 36. As injection packer body 12 is rotated in one direction (for example, clockwise), compression washer/nut 36 is caused to axially travel into expansion member body 28. This axial movement causes surface 39 of washer portion 38 to abut and compress against end 34 of expansion member body which, in turn, causes end 35 of expansion member body 28 to abut and compress against end 15 of injection packer body 12. Continued axial movement in the same direction causes compression of body 28 which causes body 28 to radially bulge. Rotation in the opposite direction (for example, counterclockwise) causes compression washer/nut 36 to move in the opposite axial direction, thereby releasing axial pressure to relieve radial bulging.

Figure 13:
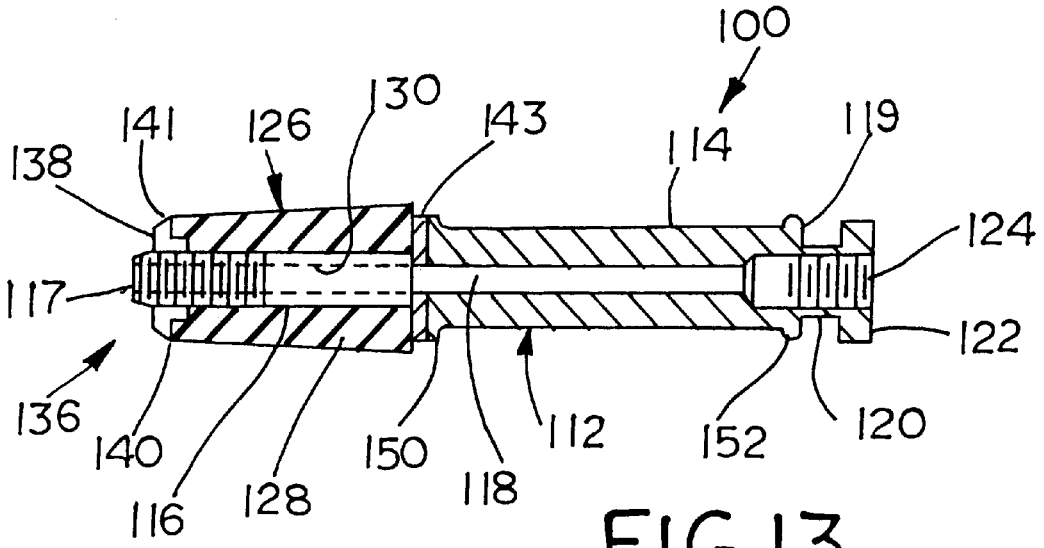
FIG. 13 is a side sectional view of another exemplary embodiment of an assembled injection packer.
Figure 14:
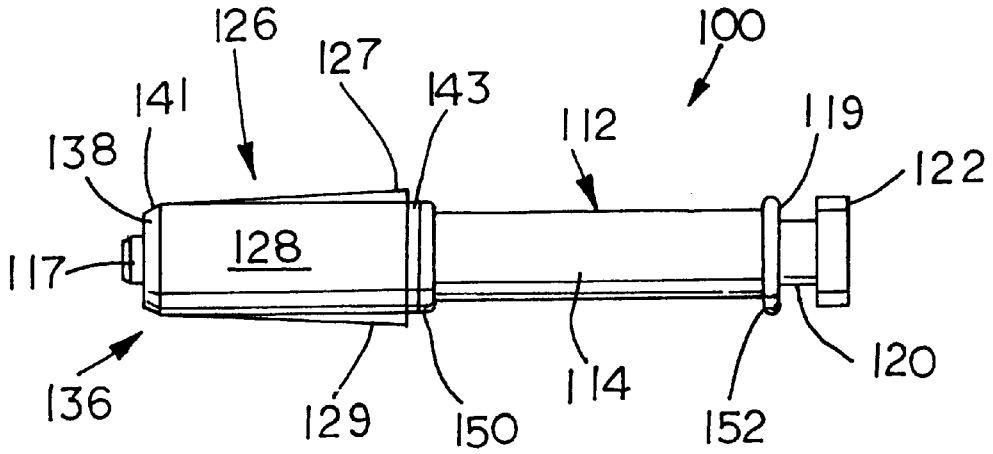
FIG. 14 is a side view of the injection packer of FIG. 13.

FIGS. 13 and 14 depict another embodiment of an injection packer and attention is now directed thereto. Injection packer 100 is essentially the same as injection packer 10 of FIG. 2, with varying features described below. In this regard, components of injection packer 100 (FIGS. 13 and 14) that are similar or identical to components of injection packer 10 (FIG. 2) are indicated by the same reference number plus one hundred. For example, shank 114 of body 112 of injection packer 100 of FIGS. 13 and 14 would be similar to shank 14 of body 12 of injection packer 10 of FIG. 2.

Injection packer 100 additionally includes annular rim 150 on one end of shank 114, preferably sized to correspondingly abut washer 143. Disposed on another end of shank 114 opposite annular rim 150 is annular rim 152, preferably sized in correlation to annular rim 150. This is accomplished by making shank 114 with a slightly smaller diameter than the diameter of annular rim 150 or annular rim 152. Stated another way, shank 114 of body 112 of injection packer 100 has a diameter that is slightly smaller than the diameter of shank 14 of body 12 of injection packer 10. If the main elongated portion of shank 114 is slightly smaller than the diameter of the bore, of which the diameter of the annular rims correspond, the amount of rubbing that occurs between the wall of the bore and the shank are reduced. Such bore for the injection packer can be ⅝", ½", or otherwise, and thus the body of the injection packer needs to be sized accordingly.

Figure 4:
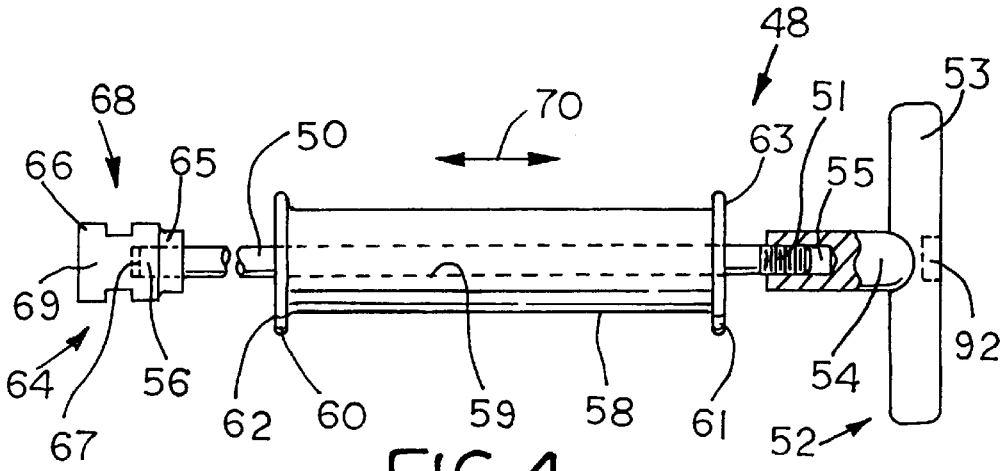
FIG. 4 is a side view of an injection packer setting/removal tool in accordance with an aspect of the present invention.
Figure 5:
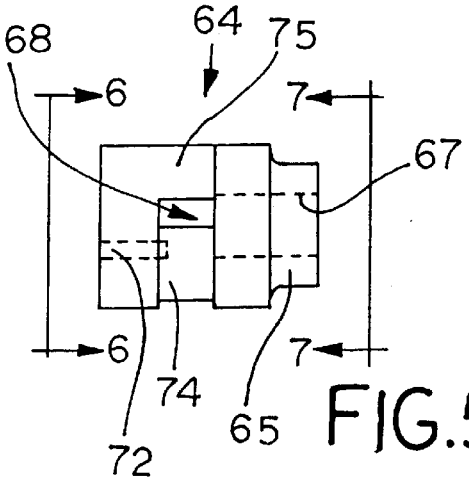
FIG. 5 is an enlarged rotated side view of the connection head of the injection packer setting/removal tool of FIG. 4.

With reference now to FIG. 4 there is depicted injection packer installation/removal tool 48 (hereinafter packer tool 48). Packer tool 48 has rod 50 onto which is slidably disposed driver 58. Driver 58 is cylindrical and includes first annular end rim 60 and second annular end rim 61. Bore 59 extends the entire axial length of driver 58 and is open at end surface 62 of annular end rim 60 and open at end surface 63 of annular end rim 61. Rod 50 is thus disposed in bore 59. Rod 50 has first threaded end 51 which is threadedly received in complementarily threaded bore 55 of handle portion 54. Handle portion 54 and handle portion 53 comprises "T" handle 52. Handle portion 53 optionally has opening, bore or socket 92 disposed in an end thereof and preferably co-axial with handle portion 54. Opening 92 may be configured as a square socket (as shown) to receive a nut driver, ratchet, or the like (not shown) to aid in turning T handle 52 of tool 48. Of course, any configuration of opening 92 or temporary engagement scheme may be used to allow an extension member or additional tool to be used in conjunction with T handle 52. Automatic, direct manual, or ratcheted manual schemes may be used.

Second threaded end 56 of rod 50 is received in bore 67 in neck or collar 65 of socket 64. Socket 64 is attached to rod 50 by complementary threads and additionally secured thereto by welding. Other attachment methods for the socket and rod may be used that are secure enough to withstand rotational forces applied to the socket by the handle through the rod as well as rectilinear forces.

Driver cylinder 58 is freely movable along rod 50 as indicated by two-headed arrow 70, but restricted at one end by rim 61 abutting handle portion 54 and at the other end by rim 60 abutting socket 64. Driver cylinder 58 is usually grasped by one hand while handle 52 is grasped by another hand to allow one hand to reciprocate driver cylinder 58. Generally, more force is applied in one direction depending on whether an injection packer is being set into a bore, or an injection packer is being removed from a bore. Socket 64 is configured to engage keyed flange nut 22 of injection packer 10 and allow keyed flange nut 22 to be received within cavity 68 defined in socket 64 via slot 66.

With reference now to FIGS. 5–9 socket 64 of packer tool 48 is depicted. Socket 64 is generally cylindrical in shape having annular collar or neck 65 with threaded bore 67 on one end thereof and slot 66 in head or top portion 69 on another end thereof. Slot 66 is dimensionally sized and configured to receive keyed flange nut 22 when keyed flange nut 22 is appropriately oriented relative thereto. Cavity 68 is defined within socket 64 by annular side walls 74 and 75 and is in communication with slot 66 such that keyed flange nut 22 passes through or into slot 66 to reach cavity 68. Cavity 68 is dimensionally sized and configured to receive and accommodate keyed flange nut 22 therein and allow keyed flange nut 22 to limitedly rotate therein. Stop pin 72, disposed within cavity 68, is axially parallel with the axis of bore 67. When flange nut 22 is received into cavity 68, as during insertion of injection packer 10 into a bore and removal of injection packer body 12 therefrom, socket 64 is rotated or turned relative to flange nut 22 causing flange nut 22 to rotate within cavity 68. Rotation of flange nut 22 in one direction will cause flange nut 22 to eventually abut or contact stop pin 72. This aligns flange nut 22 perpendicular relative to slot 66 to allow axial tugging and/or pushing against packer body 12 by tool 48.

Figure 6:
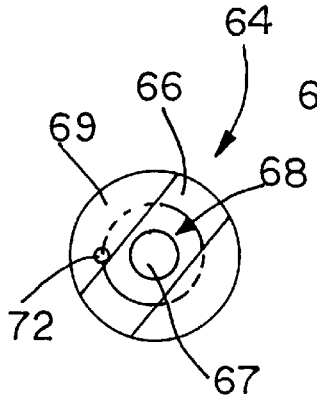
FIG. 6 is an end view of the connection head of FIG. 5 taken along line 6—6 thereof.
Figure 7:
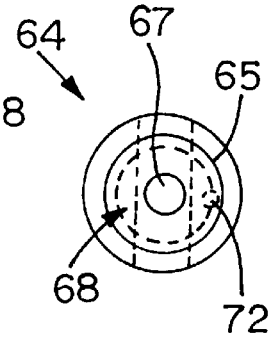
FIG. 7 is an end view of the connection head of FIG. 5 taken along line 7—7 thereof.
Figure 8:
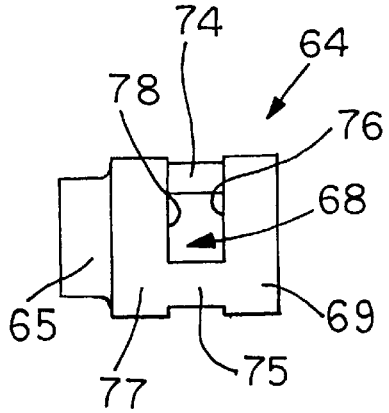
FIG. 8 is another rotated side view of the connection head of FIG. 5.
Figure 9:
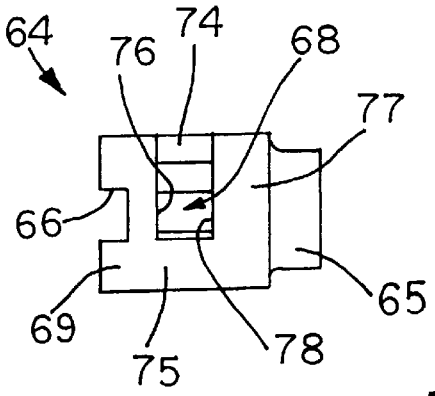
FIG. 9 is a further rotated side view of the connection head of FIG. 5.

As best seen in FIGS. 6 and 7, placement of stop pin 72 adjacent slot 66 prevents flange nut 22 from rotating in one direction while allowing rotation of flange nut 22 in the other direction. During reception of flange nut 22 into socket 64, flange nut 22 passes through slot 66 into cavity 68. Rotation of flange nut 22 in the allowed direction causes flange nut 22 to contact and abut stop pin 72 aligning flange nut perpendicular to slot 66 and capturing flange nut 22 between end 76 of head wall 69 and end 78 of wall portion 77 (see FIGS. 8 and 9). In this manner, axial movement of tool 48 causes direct axial movement of injection packer 10 or injection packer body 12. Removal of flange nut 22 from socket 64 is accomplished by reversing the above steps, e.g. rotation of flange nut 22 in an allowed direction (being opposite the allowed direction of rotation of insertion or reception of flange nut 22) relative to slot 66 and then thereout. The slots allow cleansing of socket 64.

Figure 11:
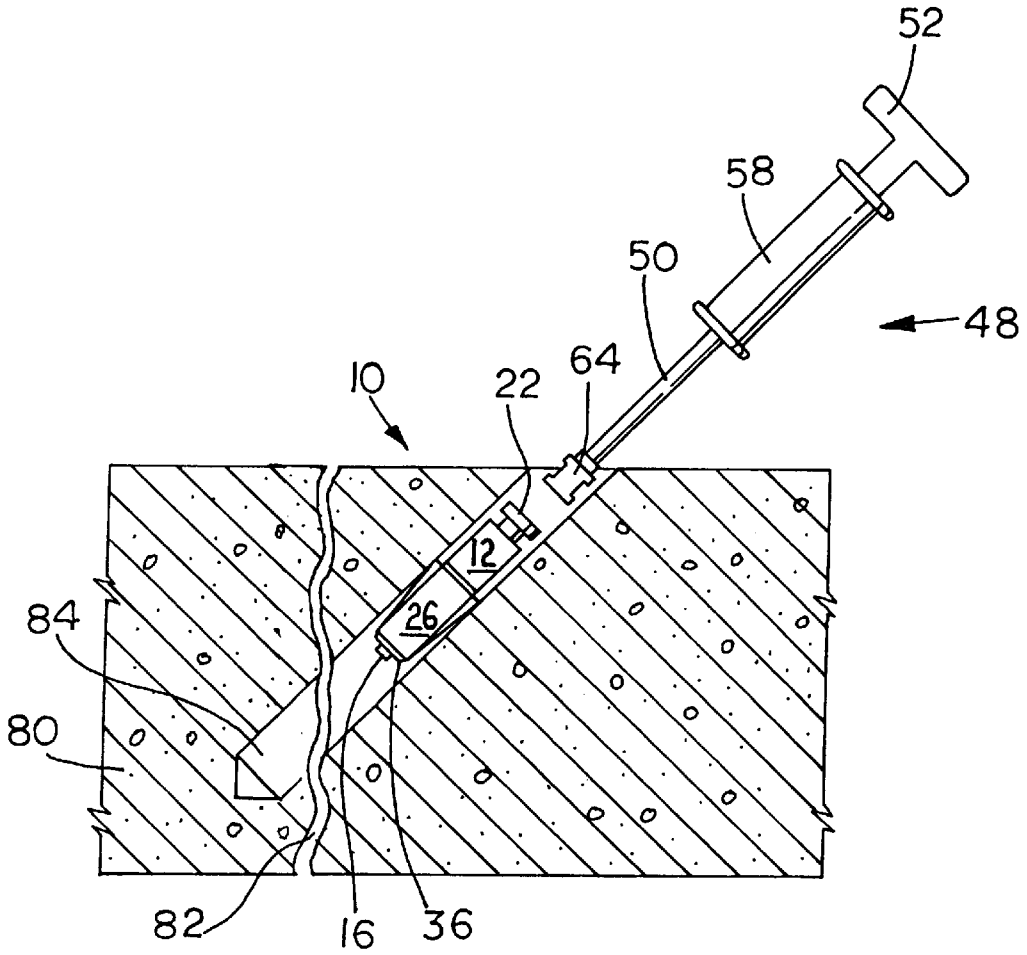
FIG. 11 is a sectional view of a portion of a concrete structure having a fissure or crack therein, a bore drilled relative thereto, and the present injection packer disposed within the bore, the injection packer in an unexpanded state.
Figure 12:
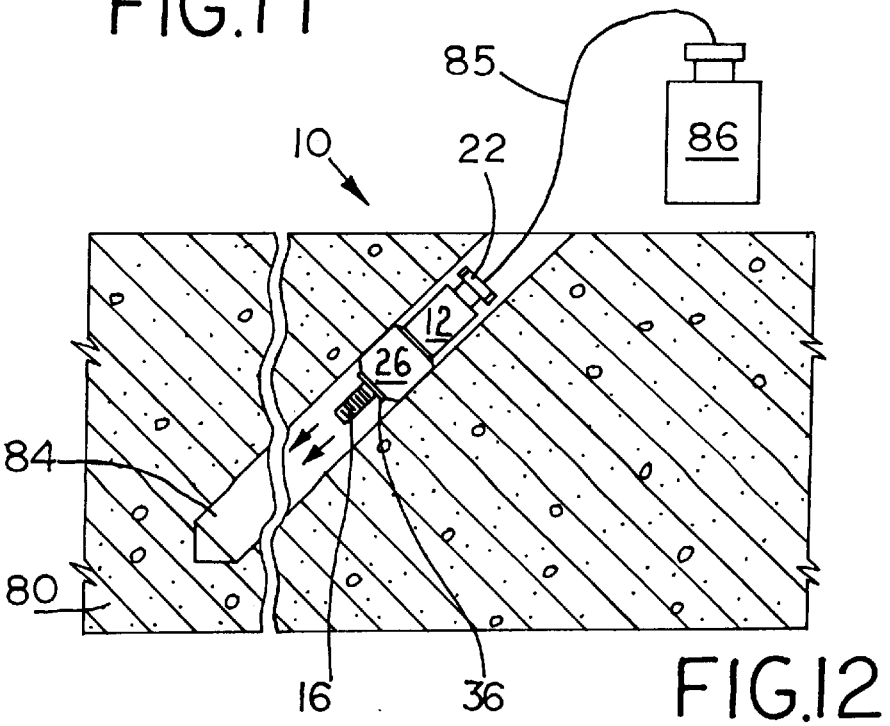
FIG. 12 is a sectional view of a portion of a concrete structure having a fissure or crack therein, a bore drilled relative thereto, and the present injection packer disposed within the bore, the injection packer in an expanded state.

With reference now to FIGS. 11 and 12 the manner of use of the present injection packer 10 and packer tool 48 will be described. In both figures, concrete structure 80 has fissure, crack, or the like 82 therein allowing the flow of liquid, generally water, therethrough. As indicated above, it should be understood that concrete structure 80 is representative of a structure of similar material. Bore 84 is drilled into concrete structure 80 such that bore 84 intersects crack 82 and is of a diameter sized to accommodate a particular injection packer. Preferably, bore 84 is drilled at a 45° angle relative thereto. Injection packer 10 is placed into bore 84 via tool 48 by first coupling the flange nut of injection packer 10 in the manner described above. Driver 58 and handle 52 are grasped by the user to hammer or drive injection packer 10 into bore 84 by the hammer action of driver 58 as driver 58 is reciprocatingly moved by the user. As injection packer 10 is driven into bore 84, the ribs on expansion member 26 grips the wall of bore 84. The ribs or ears on the expansion member 26 may be located on the rear thereof, taking the front of expansion member 26 to be where the compression member is located and that part which in placed in the bore first, rather than extending the length of the expansion member. When the ribs or ears are situated at the rear of the expansion member, any excess rib material shaved by the walls of the bore during insertion are shed away from the injection packer during insertion where any such material will not interfere with or distort uniform expansion of the expansion member.

Once injection packer 10 is situated as appropriate in bore 84, injection packer 10 must be "set" such that the injection pressure of the therethrough resin does not force injection packer 10 from bore 84. Setting of injection packer 10 is accomplished by causing expansion member 26 to expand or bulge within bore 84 thereby binding injection packer 10 within bore 84. As indicated above, rotation of the injection packer body relative to the expansion member in an appropriate direction causes compression of expansion member 26 as the end nut 36 axially moves toward shank 14 of body 12 (see FIG. 1). Handle 52 of tool 48 is used to rotate packer body 12 and thus threadedly move compression member 36 on threaded end 17 of nozzle 16 since compression member 36 does not rotate relative to expansion member 26.

As depicted in FIG. 12 expansion member 26 bulges against the wall of bore 84 to fix its position therein. Once injection packer 10 is set within bore 84, line 85 is attached to packer body 12 via a fitting (not shown), such as a zerk fitting, such that line 85 is in fluid communication with bore 18 of injection packer 10. Line 85 is coupled at the other end to a source or tank 86 of a resin or the like for injection into bore 84 as indicated by the arrows adjacent the injection packer nozzle within bore 84. The resin then flows into the bore and fissure. Of course, control mechanisms such as valves and the like (not shown) are generally used to control the flow of resin.

Once the resin or injection material has been injected into the bore and crack(s), and due time has been given for allowing the injected material to at least partially cure, the injection packer or at least a part of the injection packer is removed from the bore. This is accomplished by rotating packer body 12 relative to expansion member 26 and compression member 36 in a direction that decompresses and radially contracts the expansion member. This direction is opposite the direction to compress and radially expand the expansion member. In the decompression direction, compression member 36 axially moves along threads 17 of nozzle 16 away from shank 14 which relaxes expansion member 26 to radially contract.

Packer tool 48 is used to rotate packer body 12 after resin injection. Socket 64 engages keyed flange nut 22 by insertion of socket 64 into bore 84 by grasping handle 52 and driver 58. After rotation of socket 64 in the direction allowed by stop pin 72 through rotation of handle 52, compression member 36 axially travels to relax and radially contract expansion member 26. At this point full extraction of injection packer 10 is possible by axially pulling, tugging, or yanking on packer tool 48 via the sliding hammer action of driver 58.

Continued rotation of packer body 12 after complete radial contraction of expansion member 26 disengages nozzle 16 from compression member 36. Thereafter, packer body 12 may be pulled free of expansion member 26 and out of bore 84. In this situation, expansion and compression members 26 and 36 remain in bore 84. However, since expansion and compression members 26 and 36 are non-metallic, there will be no corrosion of remaining parts. Further, removed packer body 12 may be reused with new expansion and compression members.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. An injection packer comprising:

a body having a shank, a stem extending from one side of said shank, and a nut on another side of said shank, said body further having a body bore extending through said nut, said shank, and said stem, said stem having threads;

an expansion member having an expansion member bore therein sized to receive said stem, and at least one radially extending rotation prevention member on an outside surface thereof, said expansion member slidably disposed on said stem and having an end abutting said shank; and a compression member disposed at another end of said expansion member and adapted to threadedly engage said stem, wherein rotation of said body relative to said expansion and compression members in a first direction causes said compression member to axially compress said expansion member against said shank causing said expansion member to radially bulge.

2. The injection packer of claim 1, wherein said at least one radially extending rotation prevention member comprises a plurality of ribs disposed equidistant each other.

3. The injection packer of claim 1, wherein said radially extending rotation prevention members are tapered.

4. The injection packer of claim 1, wherein said expansion member is an elastomeric.

5. The injection packer of claim 1, further comprising a washer having a bore therein and disposed on said stem between said expansion member and said shank.

6. The injection packer of claim 1, wherein said shank has a shank diameter, a first rim of a first diameter on a first end thereof, a second rim of a second diameter on a second end thereof opposite said first end, and wherein said first and second rim diameters are each greater than said shank diameter.

7. The injection packer of claim 1, wherein said nut has at least one flat side adapted for engagement with a mating socket.

8. The injection packer of claim 7, wherein said nut is a keyed nut.

9. An injection packer comprising:

a body having a shank, a nozzle extending from one side of said shank, and a flange on another side of said shank, said body further having a body bore extending through said flange, said shank, and said nozzle, said nozzle having threads;

an expansion member having an expansion member bore therein sized to receive said stem and slidably disposed on said stem, said expansion member further having a first end abutting said shank, a second end distal said first end, and a configured recess in said second end; and a compression member having a compression surface adapted to abut said second end of said expansion member, a nut portion configured to and received in said configured recess, and a threaded bore adapted to receive said threaded nozzle, said compression member rotationally fixed to said expansion member;

wherein rotation of said body relative to said expansion and compression members in a first direction causes said compression member to axially compress said expansion member against said shank causing said expansion member to radially bulge.

10. The injection packer of claim 9, wherein said compression member is plastic.

11. The injection packer of claim 9, wherein said nut portion and said configured recess are hexagonally shaped.

12. The injection packer of claim 9, wherein said compression surface comprises a washer.

13. The injection packer of claim 10, wherein said washer is tapered on one end thereof.

14. The injection packer of claim 9, wherein said shank has a shank diameter, a first rim of a first diameter on a first end thereof, a second rim of a second diameter on a second end thereof opposite said first end, and wherein said first and second rim diameters are each greater than said shank diameter.

15. The injection packer of claim 9, wherein said flange has at least one flat side adapted for engagement with a mating socket.

16. The injection packer of claim 15, wherein said flange is a keyed flange nut.

17. An installation and removal tool for use with an injection packer, the tool comprising:

a handle coupled to one end of a rod;

a driver member slidably disposed on said rod; and a socket fixed to another end of said rod, said socket having a slot in a head end configured to receive a keyed head of an injection packer and in communication with a cavity configured to receive the keyed head and allow limited rotation of the keyed head therein.

18. The installation and removal tool of claim 17, wherein said socket further includes:

a stop pin disposed in said cavity such as to stop rotation of the keyed head of the injection packer perpendicular to said slot.

19. The tool of claim 17, wherein said driver is a cylinder having a bore therethrough.

20. The tool of claim 17, wherein said handle comprises:

a first member adapted to be attached to said one end of said rod generally co-axial therewith;

a second member attached to said first member generally perpendicular thereto; and wherein said second member includes a configured socket generally co-axial with said first member.

21. A method of positioning an injection packer relative to a bore of a structure, the method comprising:

providing an installation and removal tool having a handle coupled to one end of a rod, a driver member slidably disposed on said rod, and a socket fixed to another end of said rod, said socket having a slot in a head end configured to receive a keyed head of an injection packer and in communication with a cavity configured to receive the keyed head and allow limited rotation of the keyed head therein;

providing an injection packer having a body having a shank, a nozzle extending from one side of said shank, and a keyed flange on another side of said shank, said body further having a body bore extending through said keyed flange, said shank, and said nozzle, said nozzle having threads, an expansion member having an expansion member bore adapted to receive said nozzle therethrough, and a compression member rotationally fixed to said expansion member, said compression member having a threaded bore adapted to receive said threaded nozzle;

placing said injection packer into the bore;

engaging said keyed flange of said projection packer with said socket of said tool;

driving said injection packer into the bore by reciprocatingly moving said driver relative to said rod and impacting said driver against said socket; and rotating said socket of said tool in a first direction;

wherein rotation of said socket of said tool rotates said body relative to said expansion and compression members in said first direction causing said compression member to axially compress said expansion member against said shank causing said expansion member to radially bulge.

22. The method of claim 21, wherein the engaging of said keyed flange of said projection packer with said socket of said tool is before the placing of said injection packer into the bore.

23. The method of claim 21, further comprising:

removing said injection packer from the bore.

24. The method of claim 23, wherein the removing of said injection packer from the bore comprises:

rotating said socket of said tool in a second direction which rotates said body relative to said expansion and compression members in said second direction causing said compression member to axially uncompress said expansion member relative to said shank causing said expansion member to radially contract.

25. The method of claim 24, further comprising:

pulling said injection packer from the bore by reciprocatingly moving said driver relative to said rod and impacting said driver against said handle.

26. An injection packer comprising:

a body having a shank, a nozzle extending from one side of said shank, a keyed flange on another side of said shank, and a body bore extending through said keyed flange, said shank, and said nozzle, said nozzle having threads;

a conical expansion member having an expansion member bore therein sized to receive said stem and slidably disposed on said stem; and a compression member having a compression member threaded bore therein sized to receive said stem and disposed thereon, and adapted to threadedly engage said stem, wherein rotation of said body relative to said expansion and compression members in a first direction causes said compression member to axially compress said expansion member against said shank causing said expansion member to radially bulge.

27. The injection packer of claim 26, further comprising:

a low friction washer having a bore therein and disposed on said stem between said expansion member and said shank.

28. The injection packer of claim 27, wherein said shank has a shank diameter, a first rim of a first diameter on a first end thereof, a second rim of a second diameter on a second end thereof opposite said first end, and wherein said first and second rim diameters are each greater than said shank diameter.

29. The injection packer of claim 26, wherein said compression member comprises a brass washer bonded to said expansion member.

30. The injection packer of claim 29, wherein said compression member includes an annular taper.

* * * * *